United States Patent [19]

Owen et al.

[11] Patent Number: 4,704,843

[45] Date of Patent: Nov. 10, 1987

[54] APPARATUS AND METHOD FOR PACKAGING ARTICLES

[75] Inventors: Dave L. Owen, Wellford; David K. Domnitz, Taylors, both of S.C.

[73] Assignee: W. R. Grace & Co., Cryovac Div., Duncan, S.C.

[21] Appl. No.: 912,443

[22] Filed: Sep. 26, 1986

[51] Int. Cl.[4] ..... B65B 9/08; B65B 51/14

[52] U.S. Cl. ..... 53/450; 53/463; 53/550; 53/373

[58] Field of Search ..... 53/550, 373, 450, 463, 53/477; 156/582, 583.2, 515

[56] References Cited

U.S. PATENT DOCUMENTS

| | | | |
|---|---|---|---|
| 2,976,657 | 3/1961 | Cloud | 53/550 X |
| 3,009,298 | 11/1961 | Gerlach et al. | 53/550 X |
| 3,024,581 | 3/1962 | Cloud | 53/550 X |
| 3,126,682 | 3/1964 | Krance . | |
| 3,206,588 | 9/1965 | Peppler | 156/583.2 X |
| 3,274,746 | 9/1966 | James | 53/373 |
| 3,748,207 | 7/1973 | Campbell et al. | 156/583.2 X |
| 3,942,304 | 3/1976 | Hart et al. . | |
| 3,943,683 | 3/1976 | Kovacs et al. . | |
| 3,958,390 | 5/1976 | Pringle et al. . | |
| 3,992,851 | 11/1976 | James et al. | 53/373 |
| 4,249,364 | 2/1981 | Kawasaki et al. | 53/550 |
| 4,299,075 | 11/1981 | Gram | 53/550 |
| 4,305,240 | 12/1981 | Grevich et al. | 53/550 X |
| 4,589,247 | 5/1986 | Tsuruta et al. | 53/550 |

OTHER PUBLICATIONS (Promotional Brochure), Hayssen Econ-O-Matic RT'S, Mar. 13, 1972.

*Primary Examiner*—Horace M. Culver

*Attorney, Agent, or Firm*—John J. Toney; William D. Lee, Jr.; Mark B. Quatt

[57] ABSTRACT

Conventional horizontal form-fill-seal equipment for packaging articles such as cheese can be improved by the use of shrink barrier films. In conjunction with the use of such films, the improvement includes means for supporting the film prior to longitudinally sealing to form a tube, and means for heating sealing elements of transverse impulse type sealing dies for a limited duration, to effect sealing of the tube formed from the film.

5 Claims, 9 Drawing Figures

APPARATUS AND METHOD FOR PACKAGING ARTICLES

BACKGROUND OF THE INVENTION

This invention pertains to an apparatus and method for packaging articles, and more specifically to packaging of articles in heat sealable barrier films.

In packaging articles, and especially food articles such as blocks of cheese, the horizontal form-fill-seal machine has been used for many years and proven to be a useful and economic way of continuously packaging such articles.

This arrangement generally involves the continuous feeding of rollstock film or laminate onto a horizontal surface, and the infeeding of discrete articles at spaced intervals onto the film, followed by forming a tube of the film around the articles in a continuous fashion. The articles, for example, food items such as cheese blocks and the like, are drawn within the tube onto a wheel or turret where sealing dies grasp the tube at intervals between the articles and draw each packaged article around the wheel, effecting a transverse seal and a subsequent severing of the tube in the seal area to produce discrete packages which are typically dropped to a conveyor for further processing or packaging.

Prior to the passage of the enclosed article onto the wheel or turret, a longitudinal sealer effects a thin seal on the tube to produce a longitudinal seal in a continuous manner.

Exemplary of this technology is U.S. Pat. No. 2,976,657 (Cloud) which generally describes the process and apparatus, and in particular the wheel or turret means which carries the sealing dies for transverse sealing of the tube. This reference discloses various means for end sealing and severing the packages on the wheel, including brief heating of the heat sealer and clamping at cooler temperatures to hold the material until the heat seal has cooled. Coordination means for coordinating the feeding of film, articles to be packaged, and operation of the wheel or turret is also discussed.

Another reference, U.S. Pat. No. 3,024,581 (Cloud) discusses a similar apparatus in which tube forming guides are used to curl the sides of the film and use the loops at the film sides to support them and draw them up and over the objects to be packaged.

Also of interest is U.S. Pat. No. 3,126,682 (Krance) disclosing the use of a similar arrangement for forming a tube of heat shrinkable film about a candle or other article to be wrapped, and sequentially grasping the tube at intervals between the packaged articles, and heating the tube to permit shrinkage of the film about the article, thereafter severing each wrapped article.

U.S. Pat. No. 3,274,746 (James et al) discloses the packaging of cheese in a horizontal form-fill-seal arrangement and using gas flushing to monitor and control the internal atmosphere of the package.

U.S. Pat. No. 3,942,304 (Hart et al) discloses an improvement in the coupling/uncoupling means disclosed in U.S. Pat. No. 2,976,657 (Cloud) comprising a coupling/uncoupling means located on both sides of the wheel or turret.

U.S. Pat. No. 3,943,683 (Kovacs et al) discloses the use of an electronic pulse counter, also related to an improvement on U.S. Pat. No. 2,976,657 to Cloud.

Still another improvement in horizontal form-fill-seal technology is U.S. Pat. No. 3,958,390 (Pringle et al) which describes improvements on U.S. Pat. No. 3,274,746 to James et al, and more specifically the use of hot gas to effect the longitudinal seal.

Yet another improvement in means for limiting angular movement of the sealing units in the wheel or turret area of horizontal form-fill-seal equipment is disclosed in U.S. Pat. No. 3,992,851 (James et al) describing a plurality of contact pads carried by portions of each sealing unit on each side of a circular member for sliding engagement therewith.

As discussed earlier, the general horizontal form-fill-seal arrangement, using the simultaneous infeeding of thermoplastic film or laminate and articles placed on the film at spaced intervals, longitudinally sealing the film or laminate to form a tube and transversely sealing the film at intervals between packaged articles, has been a generally successful means for packaging articles such as food products, including blocks of cheese. Exemplary of such an apparatus is the Hayssen RT-118 horizontal form-fill-seal machine.

It would be desirable to use such equipment in connection with certain kinds of oxygen barrier film in order to increase the package shelflife and to permit a shrinkable film to be used which will result in a tighter, more esthetic finished package. It would also be advantageous to utilize a shrink barrier film that can provide a homogeneous/hermetic seal that can be easily inspected.

Unfortunately, the seal bars currently installed on such equipment are typically thermal bars which are continuously heated causing the shrink barrier films to shrink, and resulting in capillaries and voids in the seal area. This can reduce the esthetic appearance of the package and in some cases effect the hermetic seal, resulting in lost product.

Another disadvantage of the currently available equipment is the inability of the film tracking portion of this equipment to adequately support these same shrink barrier films prior to longitudinal sealing. This disadvantage arises from the relatively thin gauge of the shrink barrier films compared with relatively thick conventional laminates. These thinner films lack the vertical support inherent in thicker laminates.

It is therefore an object of the present invention to provide a seal arrangement for the transverse sealing function of such horizontal form-fill-seal equipment in order to permit the use of shrink barrier films having the characteristics described above.

It is an additional object of the present invention to provide film tracking means for supporting such shrink barrier films prior to longitudinally sealing the film.

SUMMARY OF THE INVENTION

In an apparatus for packaging articles in heat sealable thermoplastic film, the articles spaced longitudinally along the film, said apparatus including means for forming a tube from the film, means for longitudinally sealing said film, a wheel and a series of transverse sealing dies carried by said wheel to effect transverse sealing of the packaged articles between said articles as they are carried around the wheel, means for severing said tube between each packaged article, and means for coordinating the stream of articles, film, and die operation to ensure transverse sealing of the sealing dies at the proper location between packaged articles, the improvement comprising means for supporting said film prior to longitudinally sealing said film to form a tube, and means for heating sealing elements of transverse impulse type sealing dies for a limited duration, while the tube is clamped between a seal seat and seal bar of each die, to transversely seal the tube.

BRIEF DESCRIPTION OF THE DRAWINGS

Further details are given below with reference to the drawings wherein.

DESCRIPTION OF THE PREFERRED EMBODIMENTS

Figure 1:
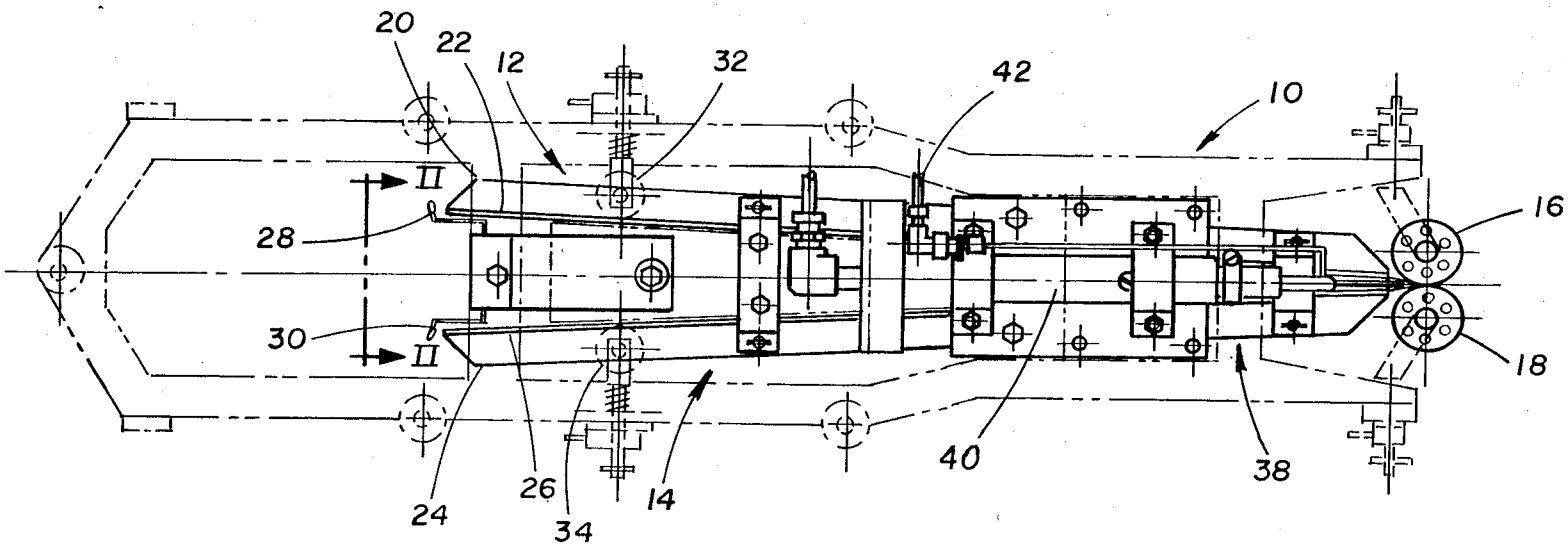
FIG. 1 is a top plan view of a longitudinal seal head assembly in accordance with the invention.
Figure 2:
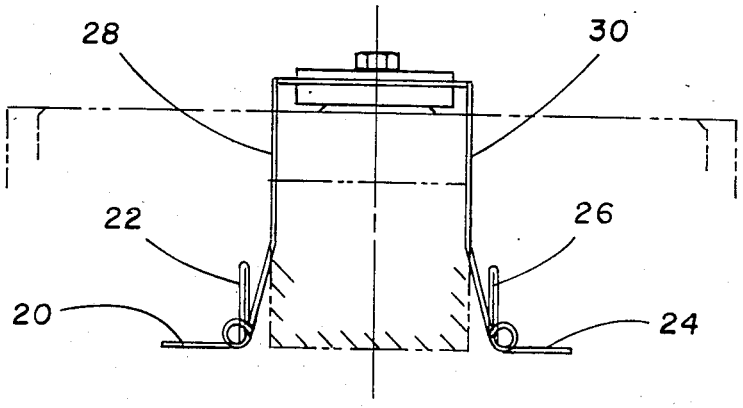
FIG. 2 is an end elevational view of the head assembly of FIG. 1 taken along lines II—II of FIG. 1.
Figure 3:
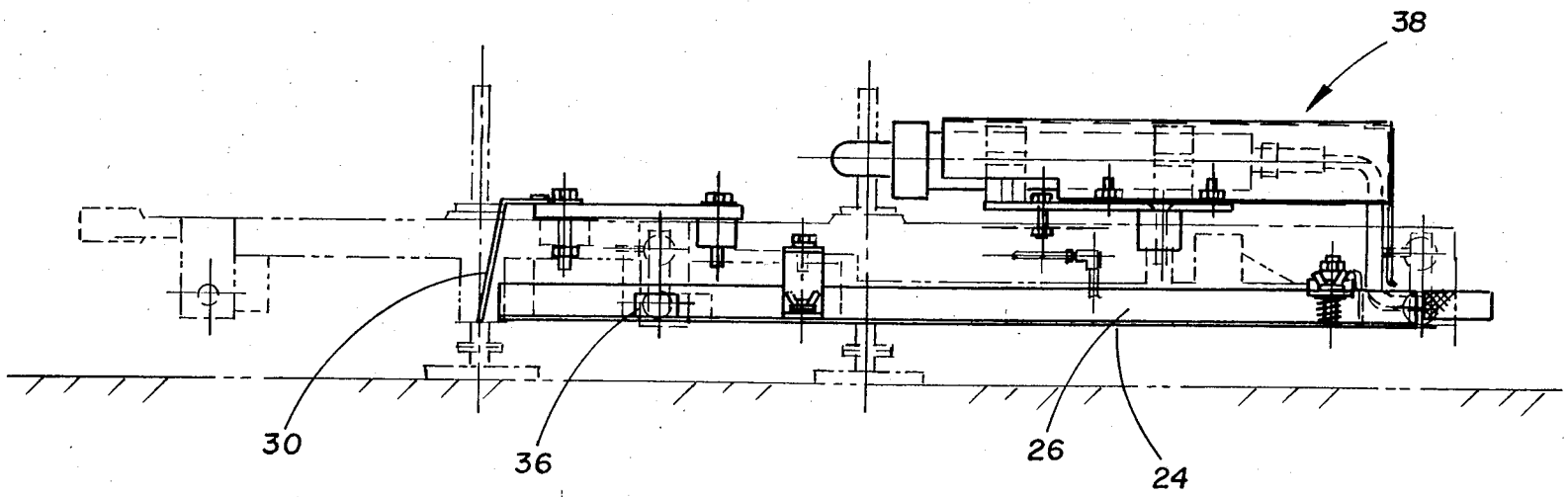
FIG. 3 is a side elevational view of the head assembly of FIG. 1.

Referring now to FIGS. 1 and 2, shrink barrier film is fed from a rollstock onto a forming table well known in the art. The shrink barrier films most preferred in connection with the present invention have a lower modulus, i.e. less stiffness than conventional laminates used in conjunction with horizontal form-fill-seal equipment. The longitudinal seal head assembly designated generally at 10 includes film guide assemblies 12 and 14 to support the left and right hand edges of the barrier film after it is fed onto the forming table and as it is formed into a tube prior to longitudinal sealing at pinch rolls 16 and 18. For purposes of this description, the left hand edge of the film (not shown for clarity) is considered that edge of the film viewed from the left hand margin of the drawing and looking towards pinch rolls 16 and 18.

Each of film guide assemblies 12 and 14 include a horizontal component and vertical component. Horizontal plate 20 of film guide assembly 12 is integrally connected, preferably as one piece, with vertical plate 22 (see FIG. 2) which has an inverted U-shaped configuration to accommodate the upper edge of the film. In like manner, horizontal plate 24 is integrally connected, preferably as one piece, with vertical plate 26, having an inverted U-shaped arrangement to accommodate the right hand edge of the packaging film.

Pin guides 28 and 30 help to remove curl on the lateral edges of the film prior to entry of the film into the left hand and right hand film guide assemblies, respectively.

Additional support and control of the path of the packaging film are provided by the film roller assemblies 32 and 34 which contact the film along the lower vertical segment of the film as it moves through the field guide assemblies 12 and 14. This contact is made through slots 36 located somewhat downstream from the edge of vertical plates 22 and 26 on each film guide assembly 12 and 14 respectively. The film edges track closer to each other as the film is drawn towards nip rollers 16 and 18 where the film is sealed for example by hot air provided by a hot air assembly 38 of the type well known in the present art. For example, an air heater 40 may be used to supply heated air through suitable conducting means to a point in the vicinity of pinch rolls 16 and 18.

Gas flushing means 42 may also be used to introduce an inert gas such as carbon dioxide to the area inside the formed tube as the longitudinal seal is effected at pinch rolls 16 and 18. It is well known that the heavier weight of for example carbon dioxide compared with ambient air tends to expel the air from the package leaving for example an interior atmosphere inside the package, and between the interior walls of the packaging film and the article, which gas may later be partially absorbed by the article if it is a moisture containing food article such as cheese. This carbon dioxide absorption results in an overall tighter package.

Figure 4:
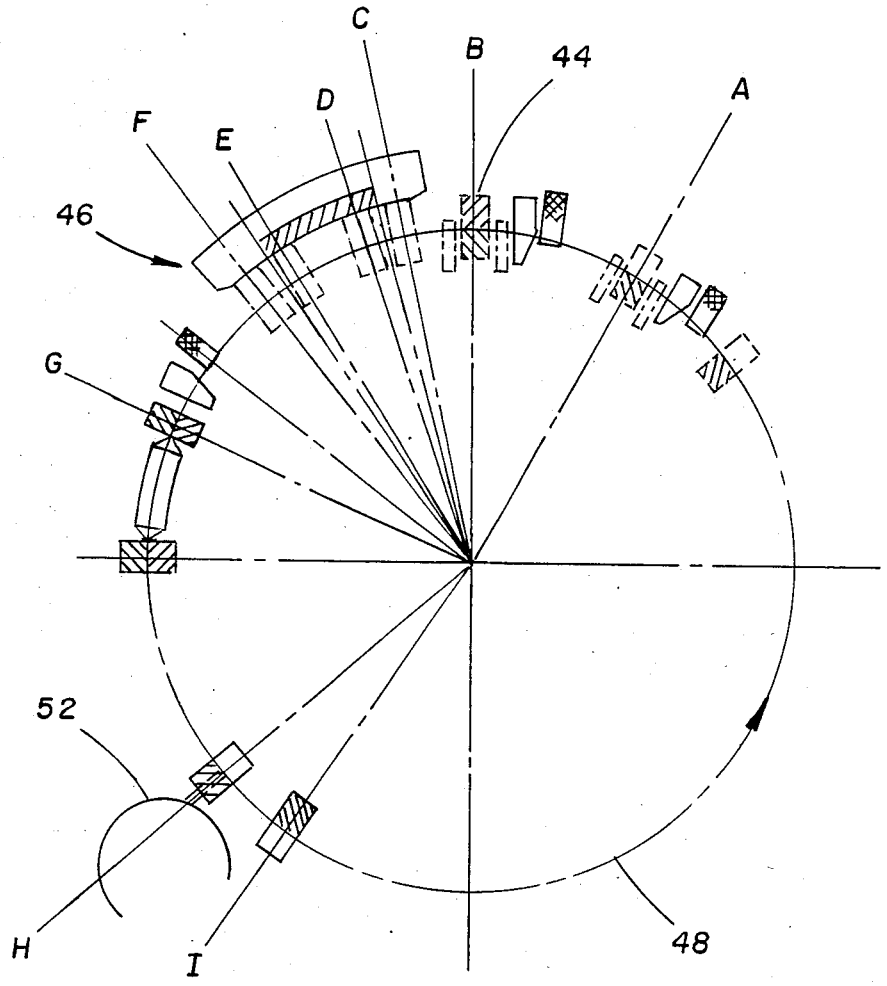
FIG. 4 is a schematic side view of the end or transverse seal operation in accordance with the present invention.

Referring now to FIG. 4 of the drawings, a schematic is shown indicating the general steps for transversely or end sealing the packaged articles after the longitudinal sealing step has been completed. Conventional die stops are preferably used to hold one or, more preferably, a series of sealing dies 44 (Position A). These are not the continuous heating thermal sealing dies of the prior art, but rather impulse sealing dies which are activated for part of the time that they are in contact with the packaging film and slip ring assembly 46.

In operation, the longitudinally sealed packaging tube, having food articles intermittently disposed within the tube, is fed towards the wheel or turret 48 generally of the type conventionally known. By timing means also well known in the art, a sealing die 44 is released, and the packaging tube is clamped between seal bar 56 and seal seat 58 of sealing die 44 (Position B).

As the packaged article further progresses, a second sealing die is released to clamp the tubing on the opposite side of the article from the first sealing die 44. The sealing dies track around the wheel 48 and come into contact with a slip ring assembly 46 (Position C) where, for part of the time in which the sealing dies 44 are in contact with slip ring assembly 46 (Positions D–E), an electrical current passes from the slip ring assembly to the sealing dies and heats a pair of parallel sealing ribbons 50 of the sealing dies to produce an impulse seal in the tubing (Position F). The sealing dies continue around the wheel (counterclockwise fashion as depicted in FIG. 4) (Position G) and come into contact with a cutting cam 52 where the tubing is severed within the space between the seals produced by the sealing ribbons 50 (Position H). The pair of sealing ribbons generally produce in effect a pair of seals with a space therebetween for severing the package. The separated packaged article is then dropped for example to an exit conveyor (not shown) for further processing or shipping (Position I).

Figure 5:
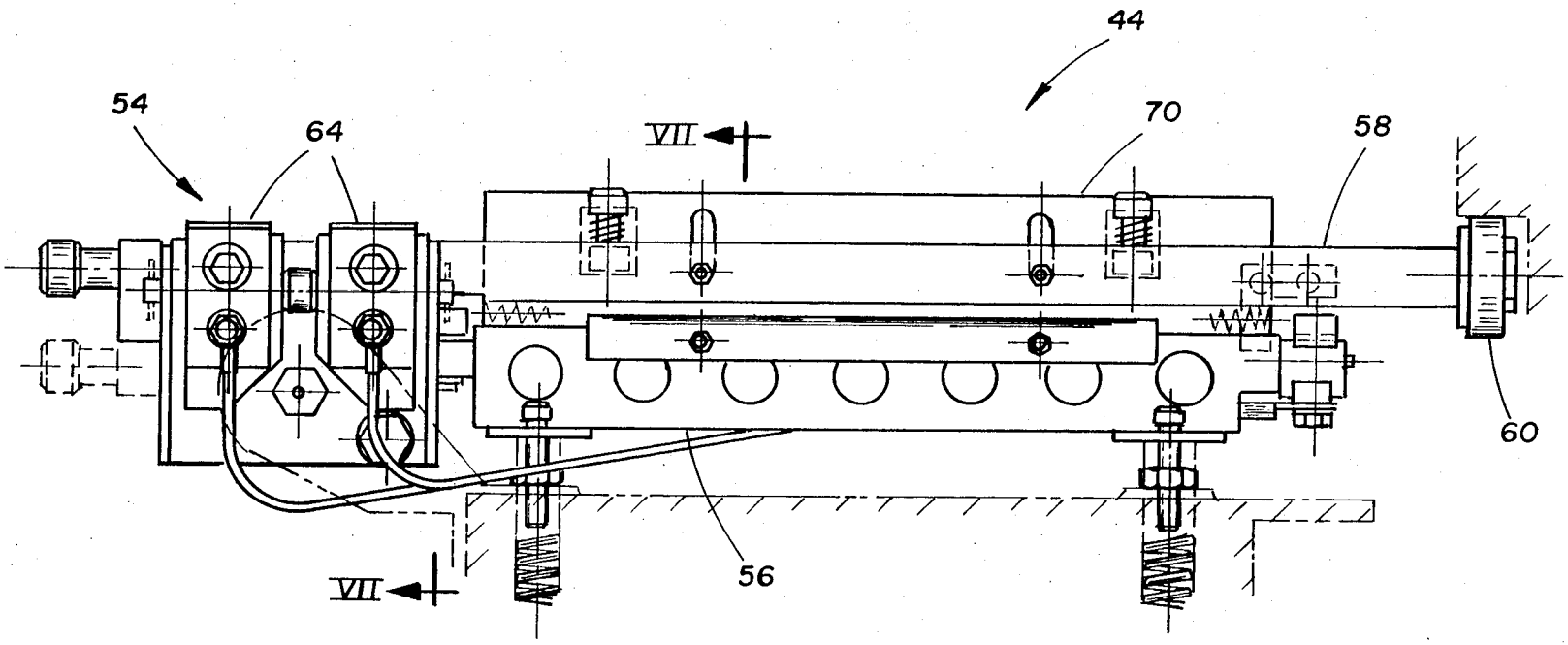
FIG. 5 is a side view of an end seal die assembly in accordance with the present invention.
Figure 6:
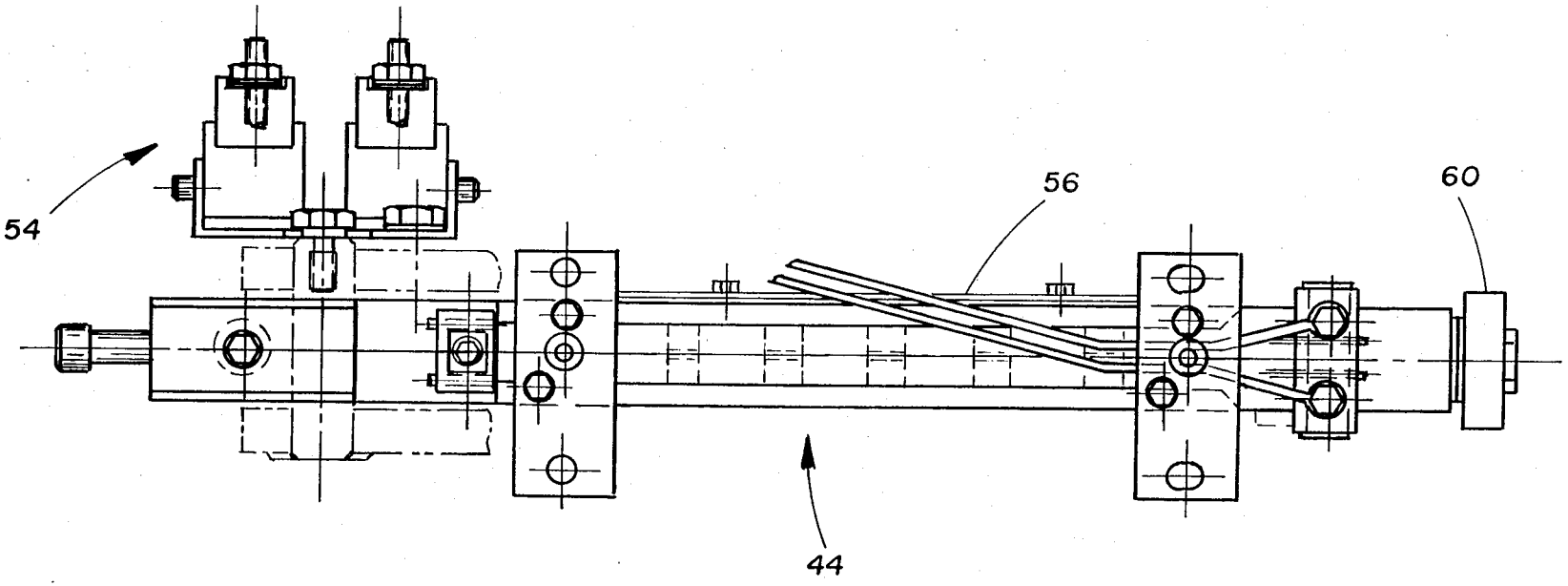
FIG. 6 is a bottom plan view of the end seal die assembly of FIG. 5.
Figure 7:
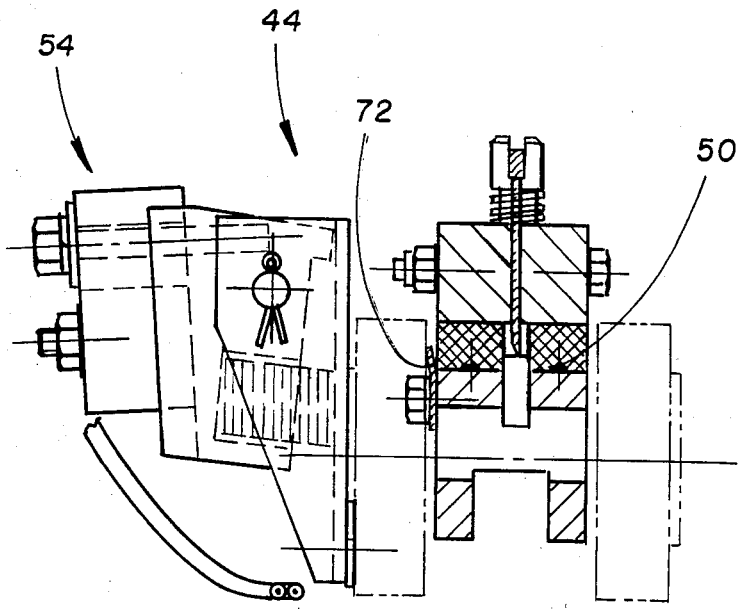
FIG. 7 is a cross-sectional view of the end seal die assembly of FIG. 5 taken along lines VII—VII of FIG. 5.

The sealing dies 44 may be seen in better detail in FIGS. 5–7, where each sealing die 44 includes a brush assembly 54, seal bar 56, and seal seat 58.

A guide roller 60 on each die maintains the sealing die in a clamped position on the film as the sealing die is advanced from the stop area and brought towards the slip ring assembly 46. This is accomplished by bringing the guide rollers 60 to bear against a frame of a conventional form-fill-seal machine.

Brushes 64 located on brush assembly 54 are brought into contact with slip rings 66 (FIG. 9) of slip ring assembly 46 as the sealing die 44 passes under the slip ring assembly in its travel around wheel 48. Electrical current passes from the slip rings 66 through brushes 64 and the brush assembly 54 to sealing die 44 by means of a suitable electrical circuit such as shown representatively in FIGS. 5 and 6.

Suitable timing means is preferably chosen such that electrical current is passed to each sealing die 44 for only a portion of the time that brushes 64 are in contact with slip rings 66. This assures that no arcing between the slip ring and the brush assembly will occur.

Seal ribbons 68 (FIGS. 7) of the type conventionally used in the impulse sealing art are employed to effect a transverse seal, actually a pair of seals, in the packaging film between adjacent articles enclosed in the packaging material.

After the end sealing operation just described, the knife 70 of each sealing die 44 is brought into forcible contact with cutting cam 52 by means of further travel of the sealing die 44 around wheel 48. At this point, the knife 70 is forced further down into the sealing die 44 in such a manner that the section of tubing between the pair of transverse seals is severed, resulting in a discrete packaged article which may then be deposited onto a conveyor or like means at a point downstream from cutting cam 52.

In normal operation, the knife 70 is loosely or resiliently suspended in such a manner within the sealing die 44 that it will not cut into the tubing at the sealed area until activated by the cutting cam 52 or similar forcing means.

A plate 72 (FIG. 7) can advantageously be used to exert tension on the packaging material during the operations just described, i.e. during the sealing and severing operations. This plate substantially reduces film slippage caused by the pulling effect of the wheel 48 and preceding sealing dies 44 in a continuous operation.

An additional plate 72 could also be located on the opposite side of the sealing die at an analogous location to that shown in FIG. 7 in order to further enhance the stability of the film during the end sealing step.

Figure 8:
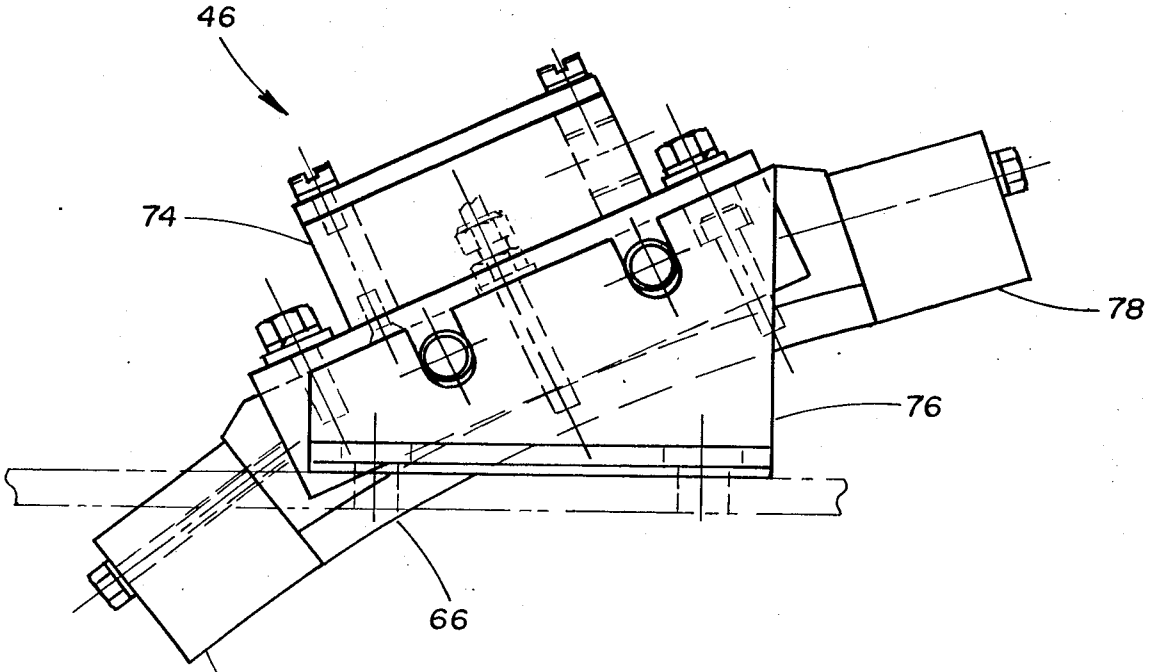
FIG. 8 is a side view of a slip ring assembly in accordance with the present invention.
Figure 9:
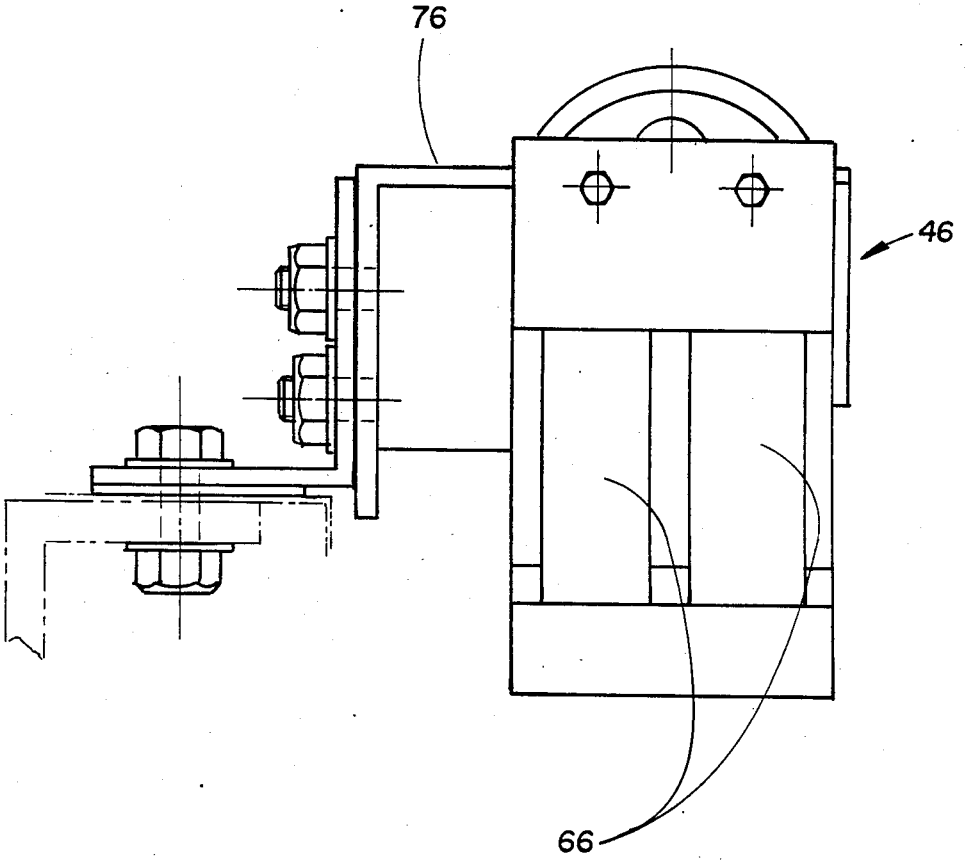
FIG. 9 is an end view of the slip ring assembly of FIG. 8.

As shown in FIGS. 8 and 9, the slip ring assembly 46 essentially comprises slip rings 66 for effecting electrical contact with the brush assembly 54 mounted to the sealing die assembly, and appropriate electrical apparatus such as terminal box 74 electrically and mechanically connected to slip rings 66. As shown, one positive and one negative slip ring 66 correspond to brushes 64 of the sealing dies 44. The slip ring assembly 46 may be mounted to an existing side frame of a conventional horizontal form-fill-seal apparatus by means of a mounting plate 76. Guides 78 can be used to help the sealing die 44 track properly as it passes in contact with the slip rings 66 of the slip ring assembly 46.

In an alternate embodiment, the relative locations of the slip ring assembly 46 and cutting cam 52 can be reversed. Thus, the seal dies 44 proceed from the stop area on the wheel and forward along the wheel track, the seal seat 58 clamping down on the tubing against seal bar 56, with the guide roller 60 in place in a suitable portion of a wheel framing. One or more plates 72 exert tension on the film. At this point in the operation, the cutting cam 52 is positioned so as to activate knife 70 and sever the tubing at intervals between packaged articles. These articles then proceed further along the wheel to the slip ring assembly 46, where the impulse seals of sealing dies 44 are activated by contact of the brushes 64 of brush assembly 54 with slip ring 66.

It has been found that greater variability and flexibility in voltage used in the sealing operation can be accommodated by the use of this alternate embodiment without substantially decreasing the reliability of the seals used by this operation. Seals can be produced by the practice of this invention with a spacing of only about one inch between the end of the packaged article and each transverse seal. With this spacing, on-line reliability can be maintained at 99.5–99.6%. With some sacrifice in reliability, but still well above 90%, the product to seal spacing may be further reduced. This results in overall shortening of the package and therefore the reduction of gas volume entrapped in the package. In the case of the use of carbon dioxide gas as a gas flushing medium, the packages pull down as the carbon dioxide gas is dissolved into the moisture of for example block cheese, and this provides a tight vacuum appearance to the package. With the use of improved shrink barrier films in accordance with the invention, hot air shrink may be applied immediately to the package after the packaging operation just described, or else delayed for about 24 hours to produce a shrunk vacuum bag appearance. In-line hot air shrinking produces a ballooning effect until the carbon dioxide gas is dissolved into the article. By delaying the application of hot air shrink for approximately 24 hours, the moisture contained in the food product, such as cheese, absorbs the carbon dioxide and provides the tighter vacuum bag appearance after subsequent hot air shrinking of the package.

Although particular embodiments of the invention have been discussed, suitable modifications and changes will become apparent to one skilled in the art upon review of the description of the invention. These modifications and changes are considered to be within the scope and spirit of the claims.

What is claimed is:

1. In an apparatus for packaging articles in heat sealable thermoplastic film, the articles spaced longitudinally along the film, said apparatus including means for forming a tube from the film, means for longitudinally sealing said film, a wheel and a series of transverse sealing dies carried by said wheel to effect transverse sealing of the packaged articles between said articles as they are carried around the wheel, means for severing said tube between each packaged article, and means for coordinating the stream of articles, film, and die operation to insure transverse sealing of the sealing dies at the proper location between packaged articles, the improvement comprising means for supporting said film prior to longitudinally sealing said film to form a tube, said means comprising:

(a) a pair of film guides disposed opposite to each other, each guide including a horizontal plate, and integrally connected therewith a vertical plate, said vertical plate having an inverted U-shaped channel to support the upper edge of the film;

(b) a pair of rollers, disposed opposite each other in slots located downstream from the edge of the vertical plates on each film guide, for supporting the lower vertical segment of the film; and (c) said U-shaped channels of said first and second film guide tapering towards each other with respect to the longest dimension of the apparatus so that the film edges track closer to each other as the film is drawn toward the means for longitudinally sealing said film.

2. In an apparatus for packaging articles in heat sealable thermoplastic film, the articles spaced longitudinally along the film, said apparatus including means for forming a tube from the film, means for longitudinally sealing said film, a wheel and a series of transverse sealing dies carried by said wheel to effect transverse sealing of the packaged articles between said articles as they are carried around the wheel, means for severing said tube between each packaged article, and means for coordinating the stream of articles, film, and die operation to insure transverse sealing of the sealing dies at the proper location between packaged articles, the improvement comprising means for heat sealing elements of transverse impulse type sealing dies for a limited duration, while the tube is clamped between a seal seat and seal bar of each die, to transversely seal the tube, said means comprising:

(a) an impulse heat sealing assembly including
  (i) a brush assembly,
  (ii) a seal bar,
  (iii) a seal seat, and
  (iv) a guide roller located at one end of said seal seat; and
(b) an arcuate slip ring assembly including slip rings disposed along an arcuate portion of the wheel, such that during a predetermined segment of the flowpath of the heat sealing assembly, the brushes on said assembly come into electrical contact with the slip rings to provide an electrical current to said assembly.

3. In a method for packaging articles in heat sealable thermoplastic film, said method including the steps of feeding the film from a rollstock onto a forming table, simultaneously feeding articles at spaced intervals onto the film, forming the film into a tube as the film progresses along the forming table, longitudinally sealing the film, advancing the articles within the tube to a wheel for transversely sealing the tube at intervals between the articles using transverse sealing means, and severing the tube at the transverse seals to produce discrete packaged articles, the improvement comprising:

(a) feeding the film from the rollstock past a pair of guides to remove curl on the lateral edges of the film;
(b) feeding the film into a pair of film guides; and
(c) vertically supporting the edges of the film while drawing the edges toward each other prior to longitudinally sealing the film to form a tube.

4. In a method for packaging articles in heat sealable thermoplastic film, said method including the steps of feeding the film from a rollstock onto a forming table, simultaneously feeding articles at spaced intervals onto the film, forming the film into a tube as the film progresses along the forming table, longitudinally sealing the film, advancing the articles within the tube to a wheel for transversely sealing the tube at intervals between the articles using transverse sealing means, and severing the tube at the transverse seals to produce discrete packaged articles, the improvement comprising:

(a) feeding a longitudinally sealed packaging tube towards the wheel,
(b) releasing a sealing die;
(c) clamping the packaging tube between a seal bar and a seal seat of said sealing die;
(d) advancing the sealing die;
(e) contacting brushes on said sealing die with slip rings of an arcuate slip ring assembly to form a seal;
(f) advancing the sealing die further; and
(g) severing the tubing within the seal to form a discrete package.

5. In a method for packaging articles in heat sealable thermoplastic film, said method including the steps of feeding the film from a rollstock onto a forming table, simultaneously feeding articles at spaced intervals onto the film, forming the film into a tube as the film progresses along the forming table, longitudinally sealing the film, advancing the articles within the tube to a wheel for transversely sealing the tube at intervals between the articles using transverse sealing means, and severing the tube at the transverse seals to produce discrete packaged articles, the improvement comprising:

(a) feeding a longitudinally sealed packaging tube towards the wheel,
(b) releasing a sealing die;
(c) clamping the packaging tube between a seal bar and a seal seat of said sealing die;
(d) severing the tube at intervals between packaged articles; then
(e) advancing the sealing die;
(f) contacting brushes on said sealing die with slip rings of an arcuate slip ring assembly to form a seal; and
(g) releasing the sealed package.

* * * * *